US012173982B2

(12) United States Patent
Wilson

(10) Patent No.: US 12,173,982 B2
(45) Date of Patent: Dec. 24, 2024

(54) CAM SYSTEMS FOR COMPOUND ARCHERY BOWS

(71) Applicant: Bowzone LLC, Kathleen, GA (US)

(72) Inventor: Dennis A. Wilson, Kathleen, GA (US)

(73) Assignee: Bowzone LLC, Kathleen, GA (US)

( * ) Notice: Subject to any disclaimer, the term of this patent is extended or adjusted under 35 U.S.C. 154(b) by 0 days.

(21) Appl. No.: 17/903,497

(22) Filed: Sep. 6, 2022

(65) Prior Publication Data

US 2023/0074333 A1 Mar. 9, 2023

Related U.S. Application Data

(60) Provisional application No. 63/318,320, filed on Mar. 9, 2022, provisional application No. 63/304,344, filed on Jan. 28, 2022, provisional application No. 63/274,971, filed on Nov. 3, 2021, provisional application No. 63/241,028, filed on Sep. 6, 2021.

(51) Int. Cl.
*F41B 5/10* (2006.01)

(52) U.S. Cl.
CPC ..... *F41B 5/105* (2013.01)

(58) Field of Classification Search
CPC ..... F41B 5/105
USPC ..... 124/25.6
See application file for complete search history.

(56) References Cited

U.S. PATENT DOCUMENTS

| | | | | |
|---|---|---|---|---|
| 6,691,692 | B1 * | 2/2004 | Adkins | F41B 5/10 124/900 |
| 7,997,259 | B2 | 8/2011 | Wilson | |
| 8,220,446 | B2 * | 7/2012 | Batdorf | F41B 5/10 124/25.6 |
| 8,276,574 | B1 | 10/2012 | Wilson | |
| 8,534,269 | B2 | 9/2013 | Wilson et al. | |
| 9,121,658 | B1 * | 9/2015 | Darlington | F41B 5/123 |
| 9,441,907 | B1 * | 9/2016 | Obteshka | F41B 5/105 |
| 2004/0074485 | A1 * | 4/2004 | Cooper | F41B 5/105 124/25.6 |
| 2012/0000451 | A1 * | 1/2012 | Grace | F41B 5/10 124/25.6 |
| 2015/0345890 | A1 * | 12/2015 | McPherson | F41B 5/1469 124/25.6 |
| 2017/0115088 | A1 * | 4/2017 | Grace | F41B 5/105 |
| 2018/0195829 | A1 * | 7/2018 | Derus | F41B 5/1403 |
| 2019/0316866 | A1 * | 10/2019 | Dorn | F41B 5/148 |
| 2023/0349661 | A1 * | 11/2023 | Shamblen | F41B 5/10 |

* cited by examiner

*Primary Examiner* — John E Simms, Jr.
(74) *Attorney, Agent, or Firm* — Luedeka Neely, P.C.

(57) ABSTRACT

A cam assembly for a compound archery bow includes a cam adjustable component. The cam adjustable component is operable to move with respect to the base by rotating a drive mechanism. The cam adjustable component may be a draw module, cable stop, and/or limb stop. When the cam adjustable component is the draw module, the cable stop and/or limb stop may be operatively connected to the draw module such that movement of the draw module simultaneously moves the cable stop and/or limb stop.

13 Claims, 10 Drawing Sheets

CAM SYSTEMS FOR COMPOUND ARCHERY BOWS

CROSS REFERENCE TO RELATED APPLICATIONS

This application claims priority to co-pending U.S. Provisional Application Ser. No. 63/241,028 filed Sep. 6, 2021; U.S. Provisional Application Ser. No. 63/274,971 filed Nov. 3, 2021; U.S. Provisional Application Ser. No. 63/304,344 filed Jan. 28, 2022; and U.S. Provisional Application Ser. No. 63/318,320 filed Mar. 9, 2022, the contents of each being incorporated herein by reference in their entireties.

FIELD

This disclosure relates to the field of compound archery bows. More particularly, this disclosure relates to a cam system for a compound bow.

BACKGROUND

Single-cam and dual-cam compound archery bows have a power cam mounted on one or both ends of the bow limbs to control the draw force on the bowstring and the bending of the limbs as the bowstring is drawn. In single-cam bows, there is a power cam on the end of one bow limb, and wheel on the end of the other bow limb to facilitate control or time take-up of a power cable at the power cam and let-out of the bowstring and control cables at the power cam as the bow is drawn. In dual-cam bows, power cams are mounted on the ends of both limbs, with each including groove segments to control let-out of the bowstring cable at the opposing cam.

With reference to FIG. 1, an exemplary dual-cam compound archery bow 8 of the prior art is depicted. The bow 8 generally includes a handle 9 with a pair of flexible limbs 10, 10' mounted at opposite ends of the handle 12. The bow 10 further includes a cam system that includes an upper cam 40 mounted to limb 10 for rotation around axle 18, and a lower cam 40' mounted to limb 10' for rotation around axle 18'. As noted above, bow 8 of FIG. 1 is a dual-cam bow in which cams 40, 40' are preferably near mirror images of each other. Thus, corresponding components of lower cam 40' are indicated herein with the same reference number and a prime symbol as compared to the components of upper cam 40.

With reference to FIGS. 1, 2, and 2A, upper cam 40 includes a generally flat base 42 having a bowstring let-out groove 23 (see FIG. 2A) extending around a portion of the periphery of the base 42 in a plane perpendicular to the axis of axle 18. Lower cam 40' similarly includes a generally flat base 42' having a bowstring let-out groove extending around a portion of the periphery of the base 42' in a plane perpendicular to the axis of axle 18'. A bowstring includes a first end 11 that extends from a bowstring anchor 17 on base 42 around groove 23 of upper cam 40 and toward low cam 40' at the opposing end of the bow 8, at which the second end 11' of the bowstring extends through groove (identified herein as 23') of base 42' to anchor 17'.

Draw modules 16, 16' are secured to corresponding bases 42, 42' such that the draw modules 16, 16' are in a fixed position as compared to bases 42, 42'. With reference specifically to FIGS. 2 and 2A, draw module 16 includes a groove 22 that extends around the axis of rotation of upper cam 40 and in a plane perpendicular to the axis of axle 18. A first cable includes a first end 13 that extends from an anchor 15 on upper cam 40 through a first groove portion of groove 22 on module 16 and then toward lower cam 40', at which the opposing end 12' of the first draw cable is secured to anchor 14' after passing around a first groove portion of groove (identified herein as 22') of module 16'. A second cable includes a first end 12 that extends from anchor 14 on upper cam 40 through a second portion of groove 22 on module 16 to lower cam 40', at which the second end 13' of the second cable extends through a second groove portion of groove 22' to anchor 15'.

With reference now to FIGS. 1 and 1A, as bowstring 11, 11' is pulled away from handle 9, the bowstring unwraps from bowstring let-out grooves of bases 42, 42'. Upper cam 40 and lower cam 40' thereby are rotated in opposite directions by draw of bowstring 11, 11', letting out portions of cable ends 13, 13' and taking up portions of cable ends 12, 12'. The portions of cable ends 12, 12' taken up into module grooves 22, 22' will typically occupy at least some portion of the module grooves 22, 22' previously occupied by cable ends 13, 13'. In other words, grooves 22, 22' of draw modules 16, 16' function both as let-out grooves for cable ends 13, 13' and as take-up grooves for cable ends 12, 12'. Limb stops 19, 19' extending out from the flat bases 42, 42' of upper cam 40 and lower cam 40' (see FIG. 2A) are positioned to abut the blow limbs to limit the draw length of the bowstring.

As explained above, the opposing upper cam 40 and lower cam 40' of dual cam archery bow 8 are thus slaved together to eliminate any cam-to-cam timing issues. The bowstring having ends 11, 11' are positioned in a first plane while the first cable having ends 13, 12' and the second cable having ends 12, 13' are positioned in a second plane. In operation, cable ends 13, 13' are let out at a significantly lower rate than the take-up of cable ends 12, 12', which results in maximum limb compression of the opposing bow limbs 10, 10'. This helps achieve a high level of stored bow energy, dynamic efficiency and kinetic energy, achieving improved arrow speed.

Most compound bows are set-up to accommodate a desired draw length of the archer intending to use the bow. In this regard, cam systems of the prior art will typically include an adjustable draw module for modifying the draw length. Further, the positioning of limb stops and/or cable stops may be adjustable to modify the draw length. However, these systems require significant time and experience to properly adjust the different drawstring characteristics (e.g., draw length, let off, and holding weight of the drawstring). Further, many of the characteristics may only be adjustable in larger increments than desired by the archer.

What is needed therefore is an improved cam system that allows for relatively simple and precise adjustments in the drawstring characteristics of a compound archery bow.

SUMMARY

The above and other needs are met by a cam assembly for a compound archery bow that includes a first drive mechanism, a second drive mechanism positioned and configured to engage the first drive mechanism, a base, and a cam adjustable component configured to be adjustably secured to the base. One of the base and the cam adjustable component includes the first drive mechanism. Rotation of the second drive mechanism is operable to move the cam adjustable component with respect to the base, and wherein movement of the cam adjustable component with respect to the base modifies at least one drawstring characteristic of the compound archery bow.

According to certain embodiments, the cam adjustable component includes at least one of a cable stop, a limb stop, and a draw module.

According to certain embodiments, the cam adjustable component includes a cable stop and the base includes a draw module such that the cable stop is independently adjustable with respect to the draw module.

According to certain embodiments, the cam adjustable component includes a limb stop and the base includes a draw module such that the limb stop is independently adjustable with respect to the draw module.

According to certain embodiments, the cam adjustable component includes the first drive mechanism, the first drive mechanism includes a plurality of gear teeth, and the second drive mechanism is a drive gear having a plurality of drive teeth configured to engage the plurality of gear teeth of the first drive mechanism.

According to certain embodiments, the base includes the first drive mechanism, the first drive mechanism includes a plurality of gear teeth, and the second drive mechanism is a drive gear having a plurality of drive teeth configured to engage the plurality of gear teeth of the first drive mechanism.

According to certain embodiments, the base includes a slot positioned adjacent a first end of the first drive mechanism and the cam adjustable component includes an aperture configured to be aligned with the slot of the base. The cam assembly further includes a fastener configured to be inserted through the aperture and into the slot for securing the cam adjustable component to the base in a plurality of positions. The cam adjustable component is configured to be moved with respect to the base when the fastener is loosened and the second drive mechanism is rotated.

According to another embodiment of the disclosure, a cam assembly for a compound archery bow includes a base having at least a first groove portion and a second groove portion, the first groove portion including a plurality of gear teeth. A drive gear having drive teeth is disposed within the first groove portion such that the drive teeth of the drive gear are operable to engage the plurality of gear teeth of the first groove portion. A draw module is configured to be adjustably secured to the base, the draw module including at least a first aperture and a second aperture, the first aperture configured to engage the drive gear such that rotation of the drive gear is operable to move the draw module with respect to the base, the second aperture being aligned with the second draw module groove portion such that the second groove portion is configured to receive first a fastener along a plurality of positions of the second groove portion. The draw module is further configured to be in an adjustable position when at least the first fastener is loosened with respect to the second groove portion and the draw module is configured to be in a fixed position when the fastener is tightened with respect to the second groove portion.

According to certain embodiments, the draw module includes a cable stop incorporated into one end of the draw module such that movement of the draw module with respect to the base simultaneously moves the cable stop with respect to the base. In some embodiments, the cable stop is independently adjustable with respect to the draw module.

According to certain embodiments, the draw module includes a limb stop incorporated into one end of the draw module such that movement of the draw module with respect to the base simultaneously moves the limb stop with respect to the base. In some embodiments, the limb stop is independently adjustable with respect to the draw module.

According to certain embodiments, the draw module includes a cable stop incorporated into a first end of the draw module and a limb stop incorporated into a second end of the draw module such that movement of the draw module with respect to the base simultaneously moves the cable stop and the limb stop with respect to the base.

According to certain embodiments, the base is a draw module base and includes a first side and a second side with the draw module configured to be adjustably secured to the first side of the draw module base. The draw module base further includes a third groove portion and a fourth groove portion. The cam assembly further includes a limb stop base disposed on the second side of the base having a first end and a second end, a second fastener for securing the first end of the limb stop base to the draw module through the third groove portion, a limb stop disposed on the second end of the limb stop base and positioned within the fourth groove portion. When at least the first fastener is loosened with respect to the second groove portion and the second fastener is loosened with respect to the third groove portion, the draw module is operable to be moved with respect to the base by rotation of the drive gear such that the limb stop is simultaneously moved with respect to the fourth groove portion.

According to another embodiment of the disclosure, a cam assembly for a compound archery bow includes a base, a draw module configured to be movably positioned with respect to the base, and at least one of a cable stop and a limb stop operatively connected to the draw module such that movement of the draw module with respect to the base simultaneously moves the at least one of the cable stop and the limb stop with respect to the base.

According to certain embodiments, the cable stop and the limb stop are operatively connected to the draw module.

According to certain embodiments, the cable stop is operatively connected to the draw module and the cable stop is incorporated into one end of the draw module.

According to certain embodiments, the cable stop is operatively connected to the draw module and the cable stop is independently adjustable with respect to the draw module.

According to certain embodiments, the limb stop is operatively connected to the draw module and the limb stop is independently adjustable with respect to the draw module.

According to certain embodiments, the base is a draw module base having a first side and a second side with the draw module configured to be adjustably secured to the first side of the draw module base. The draw module base further includes a limb stop base groove portion and a limb stop groove portion. The cam assembly further includes a limb stop base disposed on the second side of the base having a first end and a second end, a fastener for securing the first end of the limb stop base to the draw module through the limb stop base groove portion, and a limb stop disposed on the second end of the limb stop base and positioned within the limb stop groove portion. When at least the fastener is loosened with respect to the limb stop base, the draw module is operable to be moved with respect to the base and the limb stop is simultaneously moved with respect to the limb stop groove portion.

BRIEF DESCRIPTION OF THE DRAWINGS

Other embodiments of the disclosure will become apparent by reference to the detailed description in conjunction with the figures, wherein elements are not necessarily to scale so as to more clearly show the details, wherein like reference numbers indicate like elements throughout the several views, and wherein.

DETAILED DESCRIPTION

According to the present disclosure, and as further described below, various cam assemblies are disclosed herein having one or more cam adjustable components operable to be adjusted using a first drive mechanism and a second drive mechanism that is configured to engage the first drive mechanism. Upon rotation of the second drive mechanism, the cam adjustable component is moved with respect to the base for modifying at least one drawstring characteristic of the compound archery bow. The cam adjustable component may be a draw module, a cable stop, and/or a limb stop. In certain embodiments, the base is the draw module itself with the cable stop and/or limb stop being the cam adjustable component that is able to be moved with respect to the draw module by rotation of the second drive mechanism.

Figure 3:
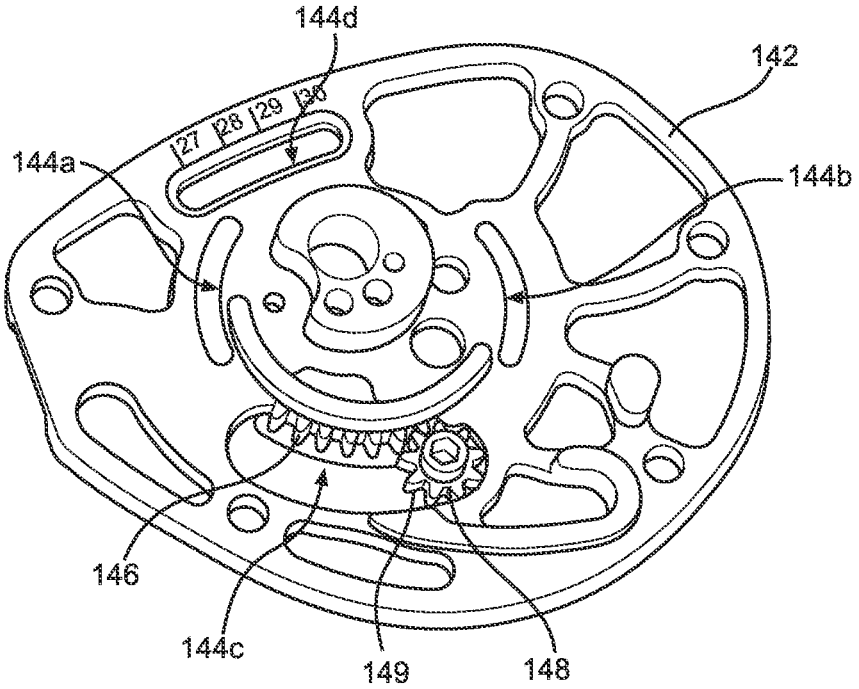
FIG. 3 is a front perspective view of the base of a cam assembly according to one embodiment of the disclosure.
Figure 4:
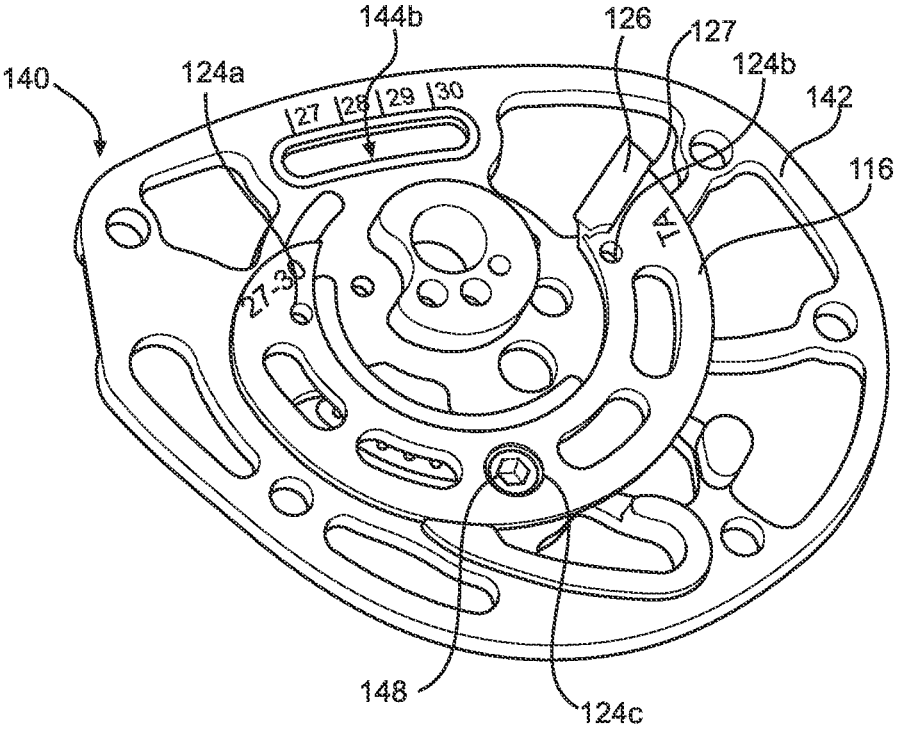
FIG. 4 is a front perspective view of a cam assembly having a draw module in operational relationship with the base of FIG. 3 according to one embodiment of the disclosure.

With reference to FIGS. 3-4, a cam assembly 140 according to one embodiment of the present disclosure is depicted. The cam assembly 140 includes a base 142 as depicted in FIG. 3, and a draw module 116 configured to be adjustably secured to the base 142 as generally depicted in FIG. 4. Cam assembly 140 is intended to be incorporated into a compound archery bow similarly to upper cam 40 and lower cam 40' as described in the Background section herein.

As shown best in FIG. 3, base 142 includes a plurality of grooves 144*a*, 144*b*, and 144*c* for guiding the movement/positioning of the draw module 116 with respect to the base 142. According to this embodiment, groove 144*c* includes a first drive mechanism in the form of a plurality of gear teeth 146 disposed in a side wall of the groove 144*c*. A corresponding second drive mechanism in the form of a drive gear 148 having drive teeth 149 is disposed in the groove 144*c*. The second drive mechanism is configured to engage the first drive mechanism such that rotation of the second drive mechanism is operable to move the draw module 116 with respect to the base 142. More specifically, with respect to this particular embodiment, the teeth 149 of the drive gear 148 are operable to engage or otherwise mesh with teeth 146 of the groove 144*c*. With reference to FIG. 4, draw module 116 includes a plurality of apertures 124*a*, 124*b*, and 124*c* that correspond to grooves 144*a*, 144*b*, and 144*c* of base 142. Aperture 124*c* is positioned and configured in the draw module 116 such that a portion of the drive gear 148 is accessible through the aperture 124*c* when the draw module 116 is operatively connected to the base 142. With the aperture 124*c* positioned to access drive gear 148, apertures 124*a* and 124*b* are then positioned and configured to align with corresponding grooves 144*a* and 144*b* such that fasteners (not shown) may be inserted through the apertures 124*a* and 124*b* to secure the draw module 116 to the base 142 using slots 144*a* and 144*b*.

To adjust the position of the draw module 116, the fasteners inserted through apertures 124*a* and/or 124*b* of draw module 116 are first loosened or otherwise removed with respect to grooves 144*a* and/or 144*b* of base 142. The drive gear 148 is then rotated using a hex key or similar tool to incrementally adjust the positioning of the drive gear 148 with respect to the groove 144*c*. Moving the drive gear 148 along groove 144*c* provides a corresponding movement of the draw module 116 with respect to base 142. Once the draw module 116 is moved to its desired position, the fasteners inserted through apertures 124*a* and/or 124*b* are tightened with respect to their respective positions along grooves 144*a* and/or 144*b* to secure the draw module 116 back to the base 142.

The drive gear as described above provides micro adjustments to the draw length of the compound bow. In preferred embodiments, the drive gear provides for adjustments down to at least 0.0625 inches, thus providing a more custom draw length fit for the user. It should be understood that other means for the first and second drive mechanisms are possible and within the scope of the disclosure including a worm drive, block and tackle, wheel drive, etc.

Figure 1:
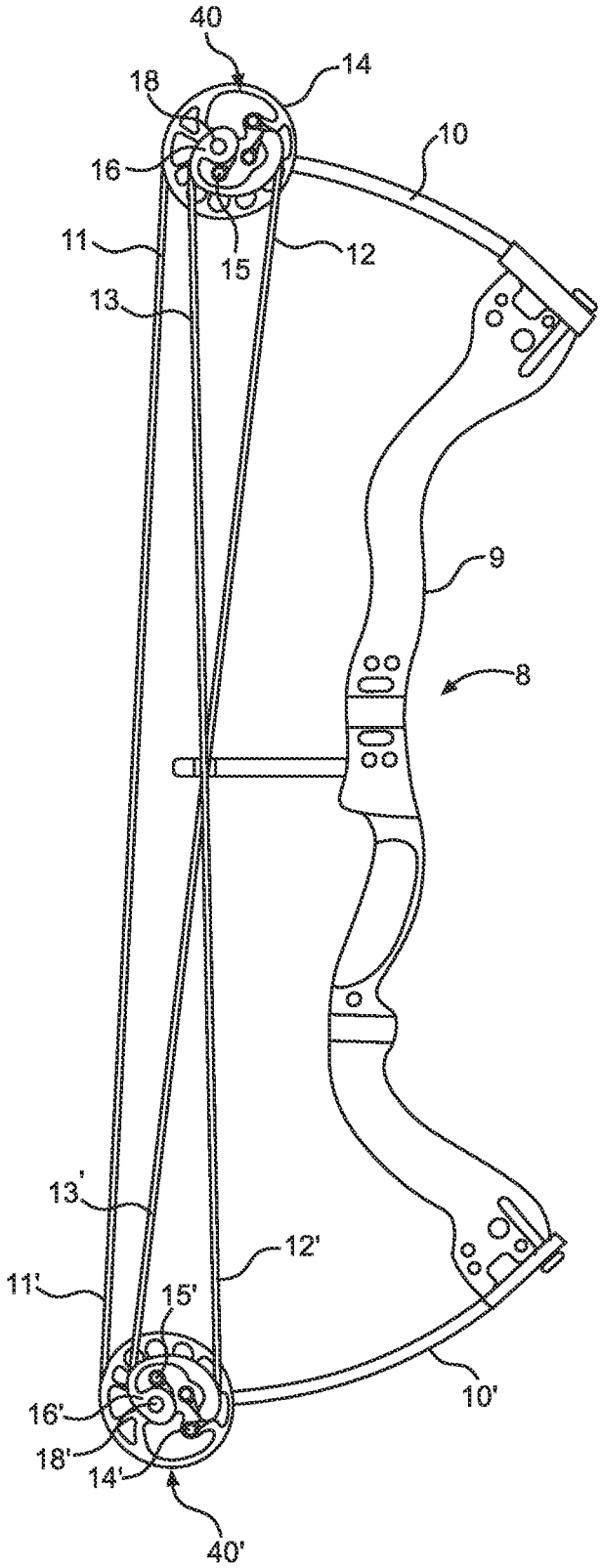
FIG. 1 PRIOR ART
FIG. 1 depicts an elevational view of a compound archery bow in accordance with an exemplary embodiment of the prior art.
Figure 1A:
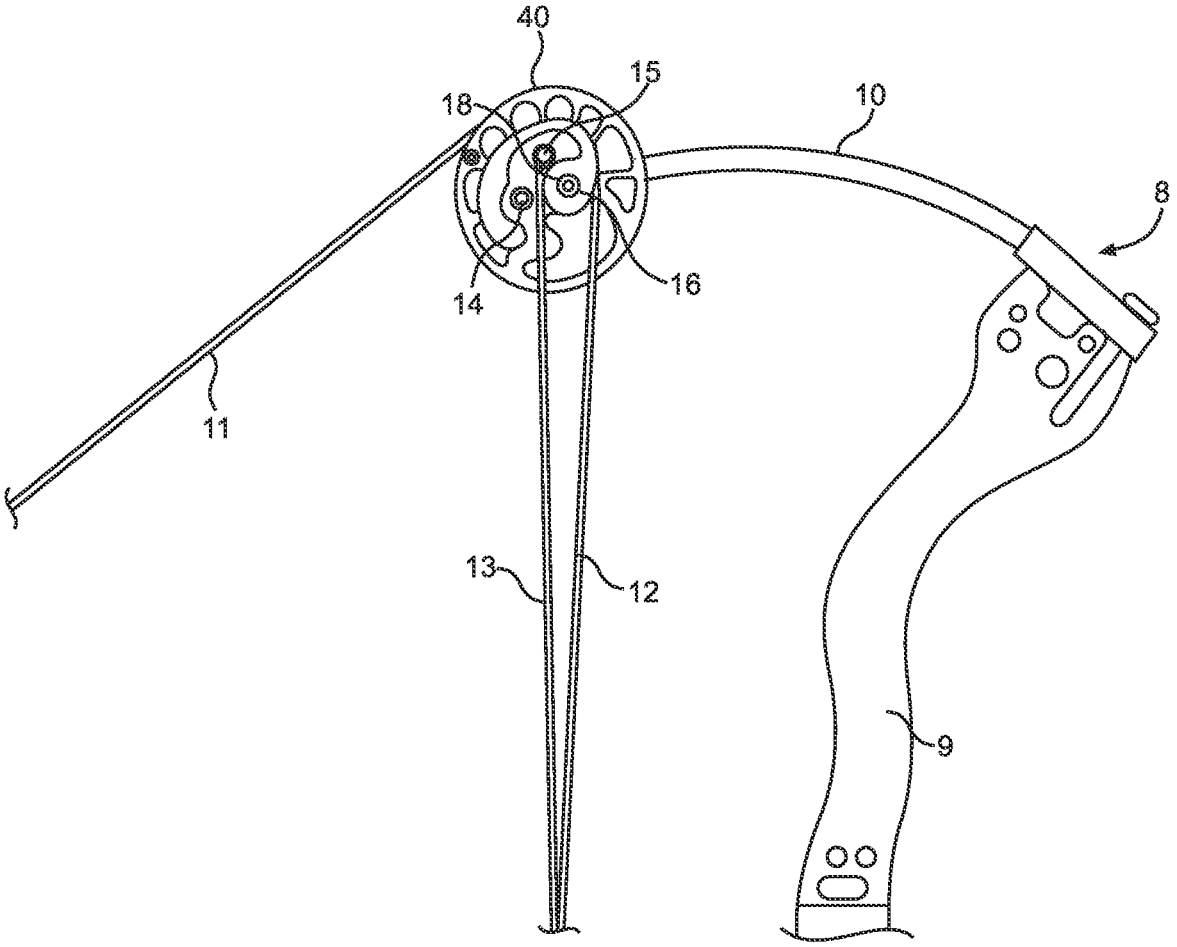
FIG. 1A PRIOR ART
FIG. 1A is a fragmentary view of the compound archery bow of FIG. 1 with the bowstring fully drawn.

According to another aspect of the disclosure, the draw module 116 of this embodiment further incudes a cable stop 126 integrated into the first end 127 of draw module 116. As shown, the cable stop 126 is a raised portion extending out from the draw module 116 that is positioned and configured to abut one of the cables of the bow to limit bow draw when the cam assembly 140 is rotated. More specifically, and assuming the cable stop feature 126 of cam assembly 140 was incorporated into the upper cam 40 and lower cam 40' of FIG. 1, cable stop 126 of the upper cam would abut cable end 13 and cable stop 126 of lower cam would abut cable end 13' when the bowstring 11 is fully drawn. Further, when the draw module 116 is repositioned with respect to base 142 by rotating drive gear 148 as described above, the cable stop 126 is automatically adjusted to the desired draw length as a result of the cable stop 126 being incorporated into the draw module 116 itself.

Figure 2:
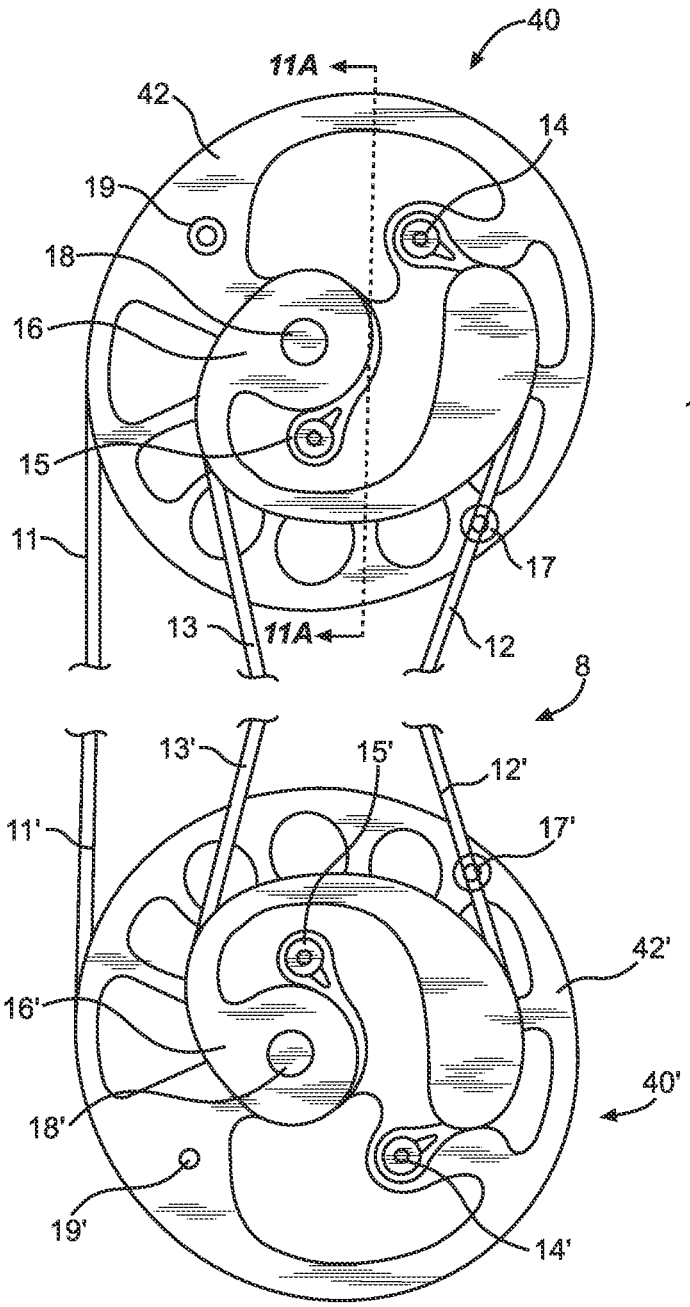
FIG. 2 PRIOR ART
FIG. 2 is a fragmentary elevational view of the upper and lower cam of FIG. 1.
Figure 2A:
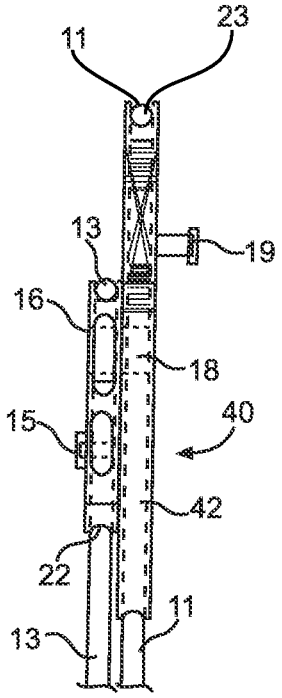
FIG. 2A PRIOR ART
FIG. 2A is a sectional view taken substantially along the line 2A-2A of FIG. 2.

According to another aspect of the embodiment of FIGS. 3-4, the base 142 of cam assembly 140 further includes an additional limb stop groove 144*d*. Limb stop groove 144*d* is positioned and configured in the base 142 to receive a limb stop similar to stop 19 of FIG. 2A. However, according to this embodiment, and as described in more detail below with respect to FIGS. 9-10 the limb stop is operatively connected to the draw module 116 such that the positioning of the limb stop is automatically adjusted along the length of the groove 144*d* upon a change in positioning of the draw module 116 with respect to base 142. In other embodiments, the positioning of the limb stop may be adjusted using a drive gear similar to drive gear 148 described above. According to this embodiment, limb stop groove 144*d* may include gear teeth in one side of the groove 144*d* and the limb stop is connected to a drive gear positioned within the limb stop groove 144*d*. Thus, in this latter embodiment, the positioning of the limb stop may be incrementally adjusted using a drive gear mechanism similar to the manner in which the position of the draw module 116 is incrementally adjusted as described above.

Figure 5:
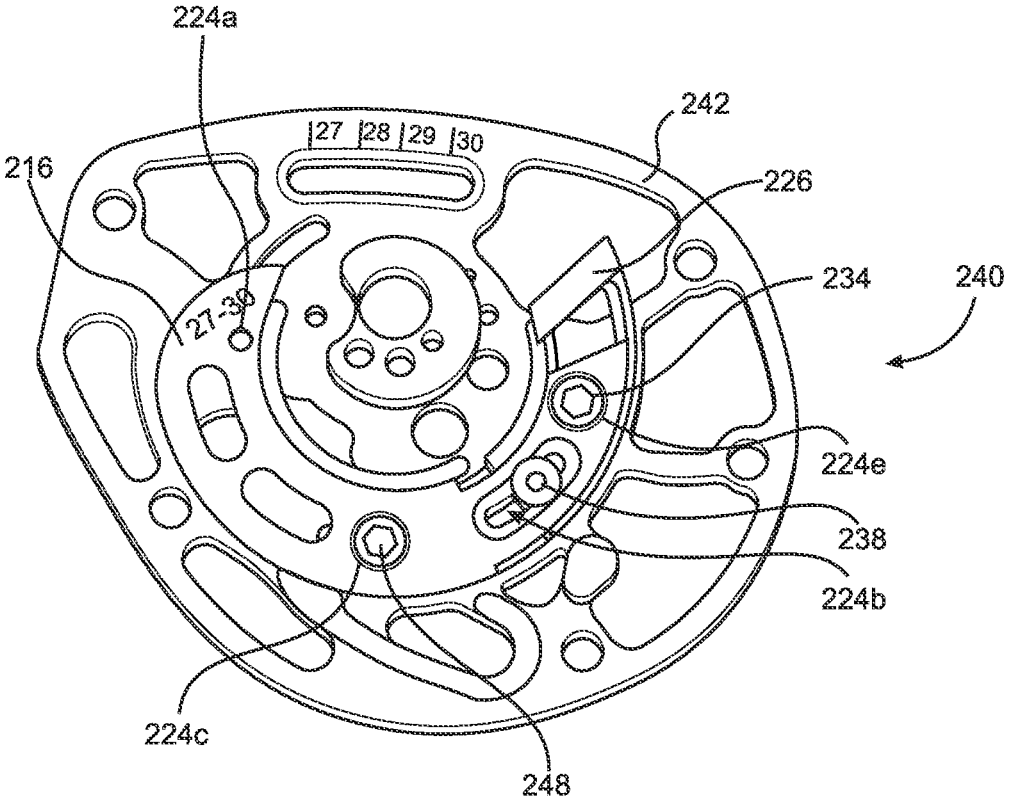
FIG. 5 is a front perspective view of a cam assembly according to another embodiment of the disclosure.
Figure 6:
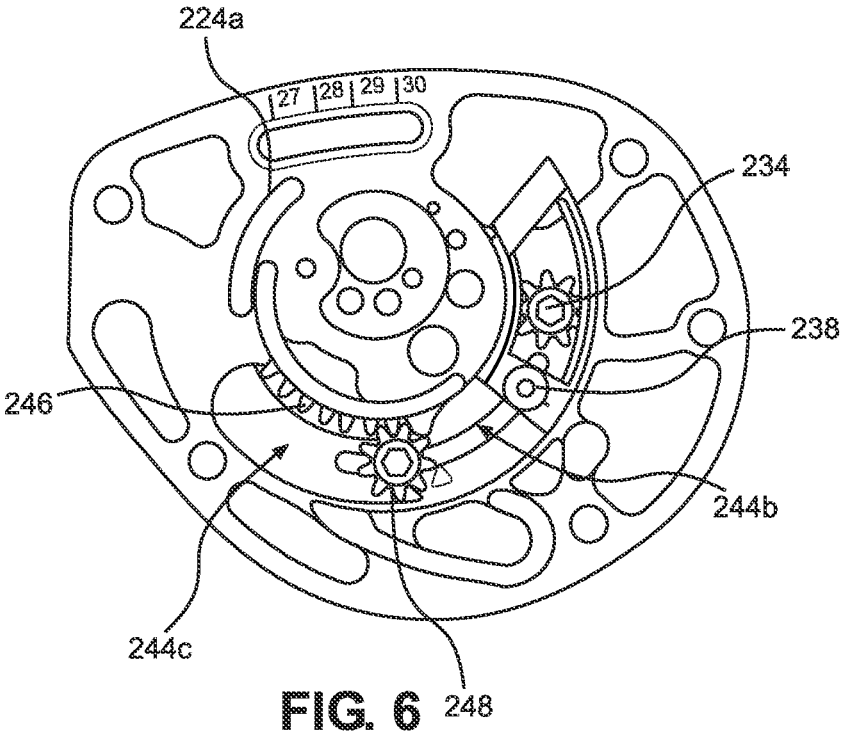
FIG. 6 is a front perspective view of the cam assembly of FIG. 5 with the base of the draw module removed.
Figure 7:
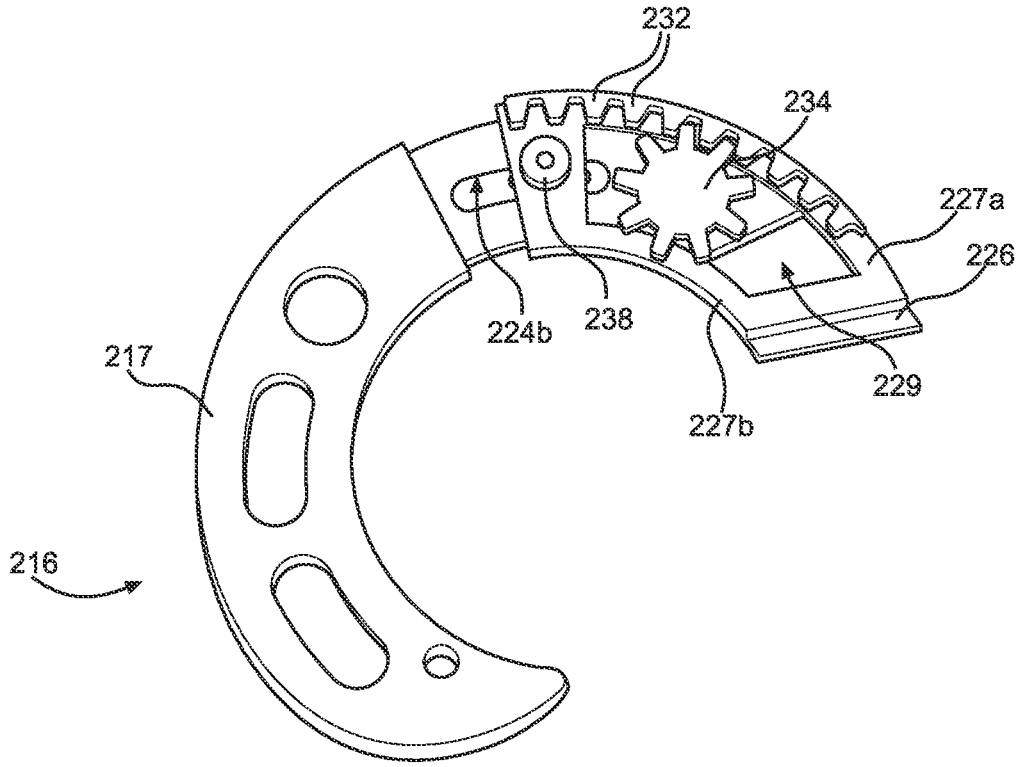
FIG. 7 is a rear perspective view of the draw module for the cam assembly of FIG. 5.

According to another embodiment of the disclosure, and with reference to FIGS. 5-7, cam assembly 240 similarly includes a gear adjustable draw module 216. More specifically, similar to cam assembly 140, cam assembly 240 includes a base 242 having a plurality of grooves 244*a*, 244*b*, and 244*c*. Draw module 216 then includes corresponding apertures 224*a*, 224*b*, and 224*c* positioned and configured to be aligned with corresponding grooves 244*a*, 244*b*, and 244*c* of the base 242. Slot 244*c* includes gear teeth 246 disposed in a side wall of the groove 244*c*. A drive gear 248 accessible through aperture 224*c* is positioned and configured to engage gear teeth 246 of groove 244*c* as described above for moving the draw module 216. However, as compared to the embodiment of FIGS. 3-4, the cable stop 226 is also independently positionable as compared to the draw module 216 using a separate drive gear mechanism. In other words, according to this embodiment, cam assembly 240 includes two cam adjustable components: the draw module 216 and the cable stop 226.

As shown best in the rear view of the draw module 216 as depicted in FIG. 7, draw module 216 includes two separate components of a base 217 and a cable stop 226. Aperture 224*b* is in the form of a slot that is positioned in the base 217 of the draw module 216. A fastener 238 is inserted through slot 224*b* of base 217 and an aperture in the cable stop 226 to secure the cable stop 226 to the draw module 216. When the fastener 238 is loosened with respect to slot 224*b*, the cable stop 226 is able to slide along slot 224*b* of base 217 to move the operative end of cable stop 226 to a desired position with respect to the base 217 of the draw module 216. The fastener 238 may then be re-tightened to secure cable stop 226 to base 217 in the desired position.

With continued reference to FIG. 7, a gear drive mechanism may also be incorporated into the cable stop 226 for incrementally moving the cable stop 226 with respect to base 217. According to this embodiment, the cable stop 226 includes a first side wall 227*a* and a second side wall 227*b* with a groove 229 disposed between the side walls 227*a*, 227*b*. At least one of the side walls 227*a* and 227*b* include a first drive mechanism in the form of a plurality of drive teeth 232. A second drive mechanism in the form of a drive gear 234 is positioned within the groove 229 for engaging drive teeth 232. As shown in FIG. 5, base 217 of draw module 216 includes an aperture 224*e* for accessing the drive gear 234. In operation, and similar to adjusting the positioning of the draw module 216 with respect to base 242, the positioning of the cable stop 226 may be adjusted with respect to base 217 of draw module by first loosening fastener 238 and then rotating drive gear 234 in an appropriate direction. Thus, according to this embodiment, the positioning of the cable stop 226 may be adjusted by rotating drive gear 248 to adjust the positioning of the draw module 216 itself with respect to base 242 and/or by rotating drive gear 234 to adjust the positioning of the cable stop 226 with respect to the base 217 of draw module 216.

Figure 8A:
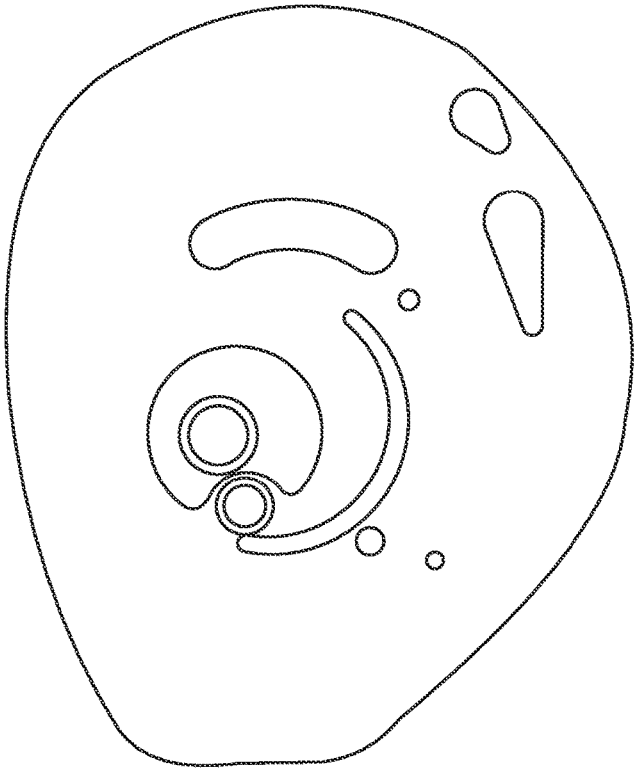
FIG. 8A is a front elevational view of a base of a cam assembly according to another embodiment of the disclosure.
Figure 8B:
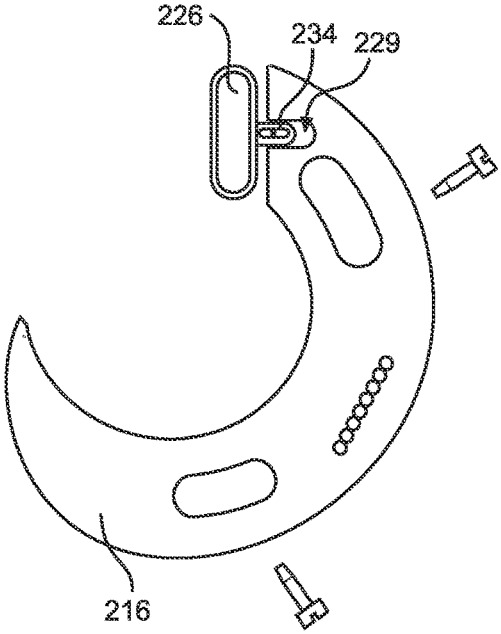
FIG. 8B is a front elevational view of a draw module intended to be adjustably secured to the base of FIG. 8A and having an independently adjustable cable stop according to one embodiment of the disclosure.

With reference to FIG. 8A-8B, an alternate embodiment of draw module 216 is depicted in which the cable stop 226 is also independently positionable with respect to the end of the draw module 216. According to this embodiment, groove 229 is disposed within the cable stop end of the draw module 216. The cable stop 226 is then connected to a drive gear 234 that is positionable within the groove 229.

Figure 9:
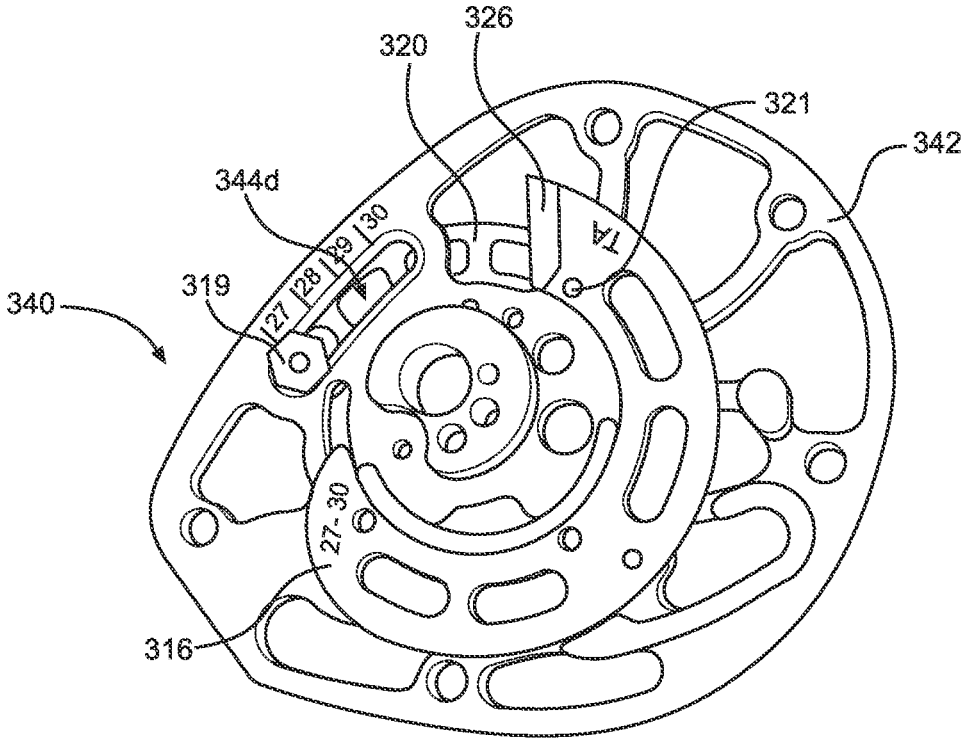
FIG. 9 is a front perspective view of a cam assembly according to another embodiment of the disclosure.
Figure 10:
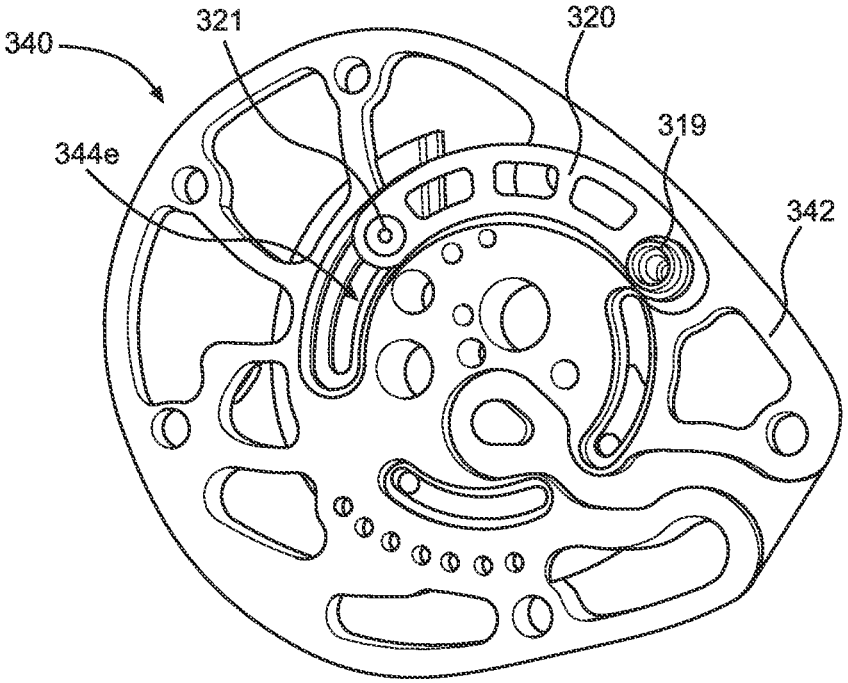
FIG. 10 is a rear perspective view of the cam assembly of FIG. 9.

According to another embodiment of the disclosure, and with reference to FIGS. 9-10, cam assembly 340 includes a draw module 316 with integrated cable stop 326 as similarly described with respect to FIGS. 3-4. According to this embodiment, the draw module 316 can be adjusted by simply sliding the module 316 along slots in the base 342 (as shown) or the movement of the draw module can be gear driven such as depicted in FIGS. 3-4. With reference to FIG. 9 showing a front view of cam assembly 340, base 342 also similarly includes a first limb stop groove 344*d* in the form of a slot extending through the base 342. With reference to FIG. 10 showing a rear view of cam assembly 340, base 342 includes a second limb stop groove 344*e* disposed in the rear side of the base 342. The cam assembly further includes a limb stop base 320. A first end of limb stop base 320 is releasably fastened to the draw module 316 and the second limb stop groove 344*e* using fastener 321. The limb stop 319 is then connected to the second end of limb stop base 320 such that it is movable within the first limb stop groove 344*d*. In operation, fastener 321 is operable to be loosened with respect to the draw module 316 and second limb stop groove 244*e*. When the draw module 316 is repositioned to a desired draw length, the draw module 316 operates to also move the limb stop base 320 within the second limb stop groove 344*e* such that the positioning of the limb stop 319 within the first limb stop groove 344*d* will also automatically be adjusted. Once the desired position for the draw module 316 is obtained, fastener 321 is tightened back to secure the limb stop 319 to the desired position within the first limb stop groove 344*e*.

Figure 11A:
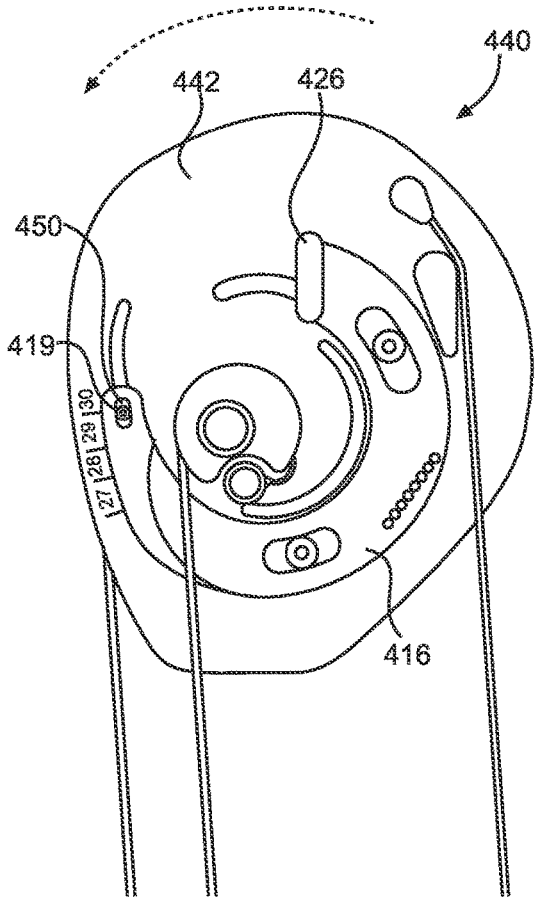
FIG. 11A is a front elevational view of a cam assembly according to another embodiment of the disclosure.
Figure 11B:
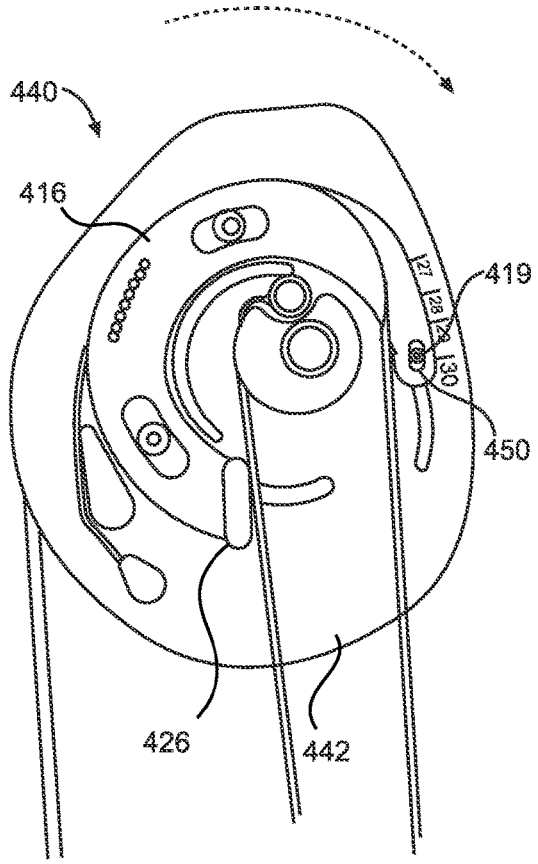
FIG. 11B is a front elevational view of the cam assembly of FIG. 11A with the bowstring being drawn.

According to another embodiment of the disclosure, and with reference to FIGS. 11A-11B, a cam assembly 440 includes a draw module 416. According to this embodiment, the cable stop 426 is integrated into a first end of the draw module 416 and the limb stop 419 is integrated into a second end of the draw module 416. Thus, according to this embodiment, adjustment of the draw module 416 with respect to base 442 automatically adjusts the positioning of the cable stop 426 and limb stop 419. As shown, module 416 may further include a slot 450 integrated into the second end of the draw module 416 for incrementally adjusting the positioning of the limb stop 419 independently of the module 416. Though it has been omitted from the embodiment depicted in FIGS. 11A-11B, it should be understood that the draw module 416 of FIGS. 11A-11B could further include the gear adjustable feature as described above with respect to FIGS. 3-4. Similarly, the embodiment of FIGS. 11A-11B could also include the gear adjustable cable stop feature as described in FIGS. 5-7.

In summary, the present disclosure provides a cam system in which a cam adjustable component such as a draw module, cable stop, and/or limb stop is easily adjustable. Further, in the case of an adjustable draw module, the draw module may incorporate an integrated cable stop and/or limb stop. Thus, when the position of the draw module is adjusted, the positioning of the cable stop and/or limb stop is also automatically adjusted. The ability to simultaneously adjust the cable stop and/or limb stop with the draw module is to prevent the user from forgetting to set a stop after adjusting the draw length, which would potentially lock up the cams at over rotation and damage the bow or user.

Further, the present disclosure also provides embodiments in which the cable stop and/or limb stop may be further adjustable independently of the draw module for additional fine tuning. For example, a user may adjust the draw module to adjust the draw length. This adjustment also adjusts the integrated cable stop and/or limb stop to the desired draw length. However, if the user felt a little more or a little less effective let off was needed, then the user could fine tune the cable stop and/or limb stop independent of the draw module.

It should be understood that many different variations of the cam assemblies are possible and within the scope of the present disclosure including, but not necessarily limited to: (1) a draw length module to where the draw length and limb stop and cable stop are all adjusted simultaneously by adjusting the positioning of the draw module; (2) a draw length module to where the draw length, limb stop, and cable stop are all adjusted simultaneously, but further micro adjustment of the limb stop and cable stop are available for finer tuning; (3) a draw length module to where the draw length is adjusted, and a limb stop and cable stop are adjusted independently of each other and the draw module; (4) a draw length module to where the draw length and a limb stop is adjusted simultaneously, and the cable stop is adjusted independently; and (5) a draw length module to where the draw length is adjusted and the cable stop is adjusted simultaneously, and the limb stop is adjusted independently.

Further, adding a micro adjustment device such as a gear drive to the cable stop and/or limb stop provides for infinite adjustments of full draw holding weight and full draw let off percentages. For example, the present disclosure provides a full draw holding weight that can be adjusted as close as ¼ pound, and a let off percentage that can be adjusted to as little as a 1-3% adjustment from the normal. While the industry has various standards of let off which amounts to holding weight, the more popular is 80% let off, so a 70-pound bow at 80% let off would have a full draw holding weight of 14 pounds. The 14 pounds can be micro-managed with a gear in place to be less or more for a more custom perfect fit and feel for the user.

Figures 12A, 12B:
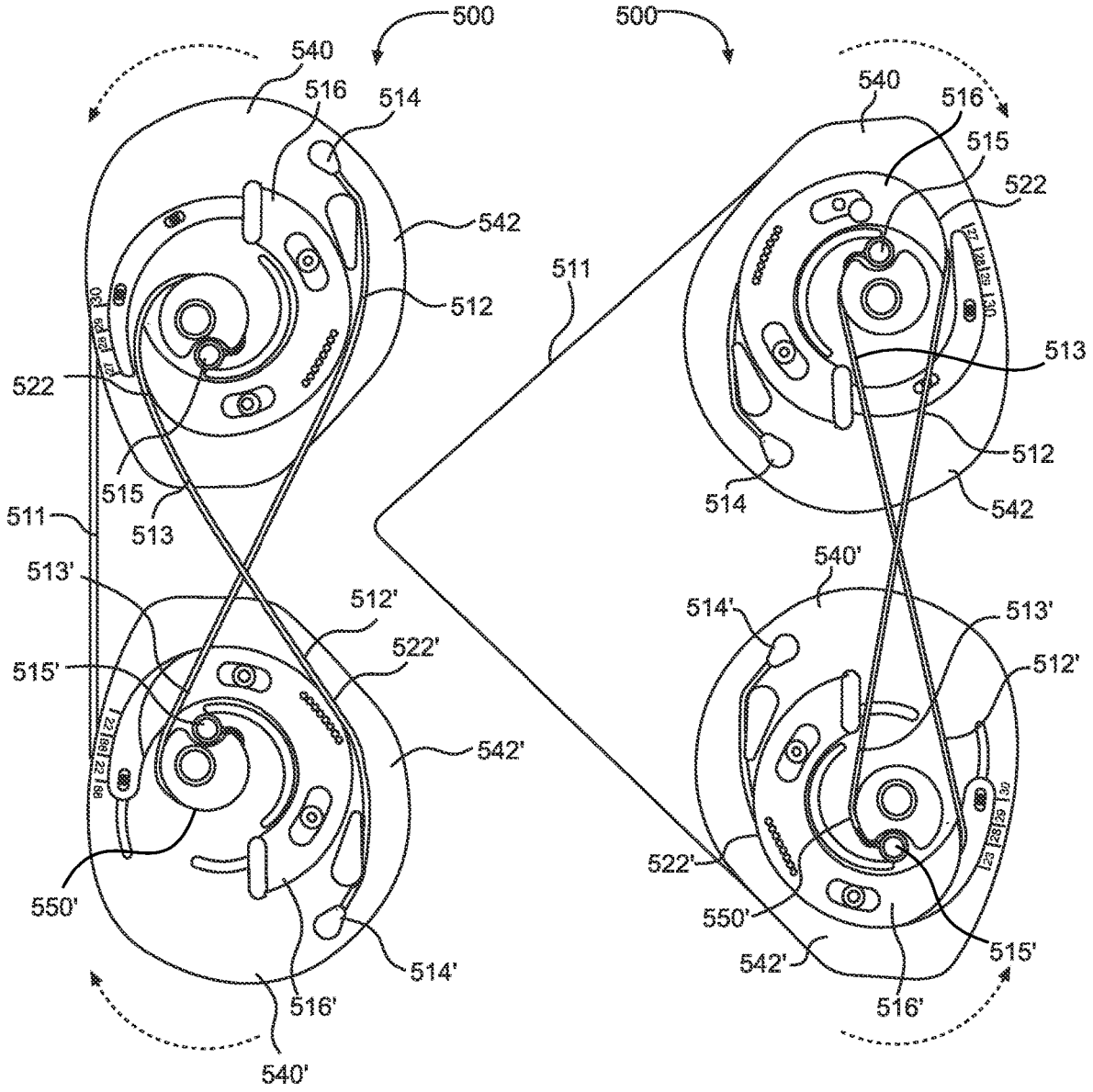
FIG. 12A is a front elevational view of a cam system according to another embodiment of the disclosure.
FIG. 12B is a front elevational view of the cam system of FIG. 12A with the bowstring being drawn.

According to another aspect of the disclosure, and with reference to FIGS. 12A-12B, cam system 500 includes an upper cam 540 and a lower cam 540'. Drawstring 511 is positioned in grooves located in a first plane of the base 542 of upper cam 540 and 542' of lower cam 540 substantially as described above with respect to FIGS. 1, 1A, 2, and 2A. In the prior art embodiment of FIGS. 1, 1A, 2, and 2A, the first and second cable were operatively connected in groves of the draw module located in a second plane. In contrast, the cam system 500 of this embodiment utilizes a two track/plane cam connected to a three track/plane cam. In preferred embodiments, and as shown in FIGS. 12A-12B, the two-plane cam is the upper cam 540 while the three-plane cam is the lower cam 540'.

More specifically, according to this exemplary embodiment, the first end 513 of the first cable extends from a cable terminating post 515 located in a second plane into a feed out groove 522 located in the draw module 516 with feed out groove 522 also disposed in the second plane. The first cable then extends to the lower cam 540' where the second end 512' of the first cable extends through a take up groove 522' located in the draw module 516' to cable terminating post 514'. Take up groove 522' of the lower cam 540' is also in the second plane according to this embodiment. The first end 512 of the second cable is then fixed to cable terminating post 514 of the upper cam 540 and extends to the lower cam 540' where the second end 513' of the second cable is wrapped around a groove 550' disposed adjacent or otherwise incorporated into cable terminating post 515'. According to this embodiment, the feed out groove 550' of the lower cam 540 is disposed in a third plane, or the groove 550' can transition from the second plane to the third plane by using a multi-plane feed out helical groove. When the groove 550' is disposed in the third plane as compared to the second plane, the second end 513' of the second cable bypasses the draw module 516' as depicted in FIG. 12A.

According to other embodiments, the three-plane cam can be implemented in the upper cam 540 while the two-plane cam can be implemented in the lower cam 540'. Further, the various grooves can be positioned in different planes as desired and within the teachings of the present disclosure. Additionally, grooves can be configured to allow the first cable and/or second cable to change planes as desired. It is also noted that the take up and feed out grooves can be located on a first cam side or a second cam side configuration. The feed out groove can also be on one cam side and the take up groove can be on the opposite cam side separated by the bowstring groove.

The foregoing description of preferred embodiments for this disclosure have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A cam assembly for a compound archery bow, the cam assembly comprising:

a first drive mechanism;

a second drive mechanism positioned and configured to engage the first drive mechanism;

a base having at least a first groove portion and a second groove portion each disposed along an arcuate path, the first groove portion including the first drive mechanism; and a draw module configured to be adjustably secured to the base such that a position of the draw module is operable to be adjusted along the arcuate path, the draw module including at least a first aperture positioned and configured to be adjustably aligned with the first groove portion and a second aperture positioned and configured to be adjustably aligned with the second groove portion, the first second drive mechanism positioned and configured to be engaged through the first aperture such that movement of the second drive mechanism with respect to the first drive mechanism is operable to move the draw module along the arcuate path of the base, the second aperture configured to receive at least_a first fastener for securing to the second groove portion at a fixed position based on the position of the second drive mechanism with respect to the first groove portion, wherein the draw module is configured to be in an adjustable position along the arcuate path when at least the first fastener is loosened with respect to the second groove portion and the draw module is configured to be in the fixed position along the arcuate path when the first fastener is tightened with respect to the second groove portion, and wherein movement of the draw module with respect to the base modifies a draw length of the compound archery bow, and further wherein the draw module includes at least one of a cable stop or a limb stop that is independently adjustable with respect to the draw module.

2. The cam assembly of claim 1 wherein the draw module includes the first drive mechanism, the first drive mechanism includes a plurality of gear teeth, and the second drive mechanism is a drive gear having a plurality of drive teeth configured to engage the plurality of gear teeth of the first drive mechanism.

3. The cam assembly of claim 1 wherein the base includes the first drive mechanism, the first drive mechanism includes a plurality of gear teeth, and the second drive mechanism is a drive gear having a plurality of drive teeth configured to engage the plurality of gear teeth of the first drive mechanism.

4. A cam assembly for a compound archery bow, the cam assembly comprising:

a base;

a draw module configured to be movably positioned with respect to the base;

a cable stop and a limb stop operatively connected to the draw module such that movement of the draw module with respect to the base simultaneously moves the cable stop and the limb stop with respect to the base.

5. The cam assembly of claim 4 wherein the base includes a first side and a second side with the draw module configured to be adjustably secured to the first side of the base and wherein the a limb stop is disposed on the second side of the base and securable to the draw module through at least one limb stop groove.

6. A cam assembly for a compound archery bow, the cam assembly comprising:

a base;

a draw module configured to be movably positioned with respect to the base;

at least one of a cable stop and a limb stop operatively connected to the draw module such that movement of the draw module with respect to the base simultaneously moves the at least one of the cable stop and the limb stop with respect to the base, and further wherein the at least one of the cable stop and the limb stop is independently adjustable with respect to the draw module.

7. The cam assembly of claim 6 wherein the cable stop is incorporated into one end of the draw module.

8. The cam assembly of claim 6 wherein the base has a first side and a second side with the draw module configured to be adjustably secured to the first side of the base, and wherein the cam assembly further comprises:

a limb stop disposed on the second side of the base and securable to the draw module through at least one limb stop groove, wherein, when the draw module is moved with respect to the base, the limb stop is simultaneously moved.

9. The cam assembly of claim 6, the cam assembly further comprising a first drive mechanism and a second drive mechanism positioned and configured to engage the first drive mechanism, wherein one of the draw module and the cable stop includes the first drive mechanism, wherein rotation of the second drive mechanism is operable to move the cable stop with respect to the draw module.

10. The cam assembly of claim 9, wherein the draw module includes the first drive mechanism, the first drive mechanism includes a plurality of gear teeth, and the second drive mechanism is a drive gear having a plurality of drive teeth configured to engage the plurality of gear teeth of the first drive mechanism.

11. The cam assembly of claim 9, wherein the cable stop includes the first drive mechanism, the first drive mechanism includes a plurality of gear teeth, and the second drive mechanism is a drive gear having a plurality of drive teeth configured to engage the plurality of gear teeth of the first drive mechanism.

12. A cam assembly for a compound archery bow, the cam assembly comprising:

a base having at least a first groove portion and a second groove portion, the first groove portion including a plurality of gear teeth;

a drive gear having drive teeth disposed within the first groove portion such that the drive teeth of the drive gear are operable to engage the plurality of gear teeth of the first groove portion;

a draw module configured to be adjustably secured to the base, the draw module including at least a first aperture and a second aperture, the first aperture configured to engage the drive gear such that rotation of the drive gear is operable to move the draw module with respect to the base, the second aperture being aligned with the second groove portion such that the second groove portion is configured to receive at least_a first fastener along a plurality of positions of the second groove portion; and a cable stop and a limb stop operatively connected to the draw module such that movement of the draw module with respect to the base simultaneously moves the cable stop and the limb stop with respect to the base, wherein the draw module is configured to be in an adjustable position when at least the first fastener is loosened with respect to the second groove portion and the draw module is configured to be in a fixed position when the first fastener is tightened with respect to the second groove portion.

13. The cam assembly of claim 12 wherein the base includes a first side and a second side with the draw module configured to be adjustably secured to the first side of the base and the limb stop is disposed on the second side of the base and securable to the draw module through at least one limb stop groove.

* * * * *